US006238180B1

(12) United States Patent
Magoshi et al.

(10) Patent No.: US 6,238,180 B1
(45) Date of Patent: May 29, 2001

(54) LEAK REDUCING STRUCTURE IN A STEAM TURBINE

(75) Inventors: Ryotaro Magoshi; Takashi Nakano; Kouji Tanaka, all of Takasago (JP)

(73) Assignee: Mitsubishi Heavy Industries, Ltd., Hyogo-ken (JP)

( * ) Notice: Subject to any disclaimer, the term of this patent is extended or adjusted under 35 U.S.C. 154(b) by 0 days.

(21) Appl. No.: 09/428,352

(22) Filed: Oct. 28, 1999

(51) Int. Cl.[7] ..... F01D 11/00

(52) U.S. Cl. ..... 415/168.4; 415/58.7; 415/59.1

(58) Field of Search ..... 415/168.1, 168.2, 415/168.4, 170.1, 174.5, 230, 58.7, 59.1

(56) References Cited

U.S. PATENT DOCUMENTS

| | | | | |
|---|---|---|---|---|
| 872,545 | * | 12/1907 | Steinmetz | 415/168.4 |
| 880,847 | * | 3/1908 | Westinghouse | 415/168.4 |
| 1,895,003 | * | 1/1933 | Meyer | 415/168.4 |
| 4,242,041 | | 12/1980 | Silvestri, Jr. . | |
| 5,632,492 | | 5/1997 | Lehmann et al. . | |

* cited by examiner

*Primary Examiner*—Edward K. Look
*Assistant Examiner*—Ninh Nguyen
(74) *Attorney, Agent, or Firm*—Alston & Bird LLP

(57) ABSTRACT

The present invention relates to a leak reducing structure in a steam turbine having high pressure, intermediate pressure, and low pressure turbine sections in a single casing, in which steam leaking from the high pressure side to the intermediate pressure side is recovered to be used effectively. The high pressure, intermediate pressure, and low pressure turbine sections are arranged along a rotor in an external casing. High-pressure steam from a high-pressure steam inlet port passes through a nozzle chamber formed integrally with a dummy ring, and flows into the high pressure turbine section to do work. On the other hand, some of high-pressure steam attempts to leak from a seal portion of the dummy ring to the intermediate pressure turbine section side. However, the leaking steam flows from point X of an external pipe to point Y on the high pressure side to be recovered. Point X is set so as to be a slightly higher pressure point than point Y, and the difference in pressure is regulated by a pressure regulating valve. Therefore, the leaking high-pressure steam is recovered and used effectively, thereby preventing the decrease in performance.

8 Claims, 3 Drawing Sheets

LEAK REDUCING STRUCTURE IN A STEAM TURBINE

BACKGROUND OF THE INVENTION AND RELATED ART STATEMENT

1. Field of the Invention

The present invention relates to a leak reducing structure in a steam turbine. More particular, it relates to a leak reducing structure in a steam turbine, which prevents a trouble such that in a steam turbine of a single casing type, high-pressure steam passes through a seal portion of a dummy ring and leaks to the intermediate pressure turbine side, by which the performance is decreased.

2. Description of Related Art

FIG. 3 is a sectional view showing the interior of a conventional steam turbine of a single casing type. In FIG. 3, reference numeral 1 denotes a rotor, 2 denotes an external casing covering the whole of the turbine, 3 denotes a high pressure turbine section in which stator blades on the stationary side and rotor blades fixed to the rotor 1 are arranged in a multi-stage form, 4 denotes an intermediate pressure turbine section in which stator blades and rotor blades are arranged in a multi-stage form in the same way, and 5 denotes a similar low pressure turbine section. These high pressure, intermediate pressure, and low pressure turbine sections 3, 4 and 5 are arranged around the rotor 1 in the axial direction thereof in the single external casing 2.

A high-pressure steam inlet port 6 supplies high-pressure steam to the high pressure turbine section 3, and a high-pressure steam outlet port 7 causes the steam that has done work in the high pressure turbine section 3 to flow out to the outside. Also, an intermediate-pressure steam inlet port 8 supplies intermediate-pressure steam to the intermediate pressure turbine section 4, and a low-pressure steam inlet port 9 supplies low-pressure steam to the low pressure turbine section 5. A nozzle chamber 13 for high-pressure steam is integrally incorporated in a dummy ring 10. The dummy ring 10 is disposed between the high pressure turbine section 3 and the intermediate pressure turbine section 4 to provide a seal. The steam that has done work in the intermediate pressure turbine section 4 and the low pressure turbine section 5 is discharged to an exhaust chamber 11.

In the steam turbine of the above configuration, high-pressure steam 30 flows into the high pressure turbine section 3 through the high-pressure steam inlet port 6, does work in the high pressure turbine section 3, and flows out through the high-pressure steam outlet port 7. Also, intermediate-pressure steam 32 flows into the intermediate pressure turbine section 4 through the intermediate-pressure steam inlet port 8, and does work in the intermediate pressure turbine section 4. Thereafter, the steam further flows into the low pressure turbine section 5. Low-pressure steam 33 flows into the low pressure turbine section 5 through the low-pressure steam inlet port 9. In the low pressure turbine section 5, the steam flowing from the intermediate pressure turbine 4 and the steam flowing through the low-pressure steam inlet port 9 are combined to do work, and are discharged to the exhaust chamber 11.

In the turbine of the above configuration, the rotor 1 is rotated in the high pressure turbine section 3, the intermediate pressure turbine section 4, and the low pressure turbine section 5 as described above, by which a generator (not shown) connected to the rotor 1 is rotated. Between the high pressure turbine section 3 and the intermediate pressure turbine section 4, there is disposed the dummy ring 10 to provide a seal. Therefore, some of the high-pressure steam passes through a seal portion of the dummy ring 10, and causes a leak to the side of the intermediate pressure turbine section 4 as a leak 34, resulting in a decrease in performance.

As described above, in the steam turbine comprising the high pressure, intermediate pressure, and low pressure turbine sections in the single casing, the dummy ring 10 for providing a seal is provided between the high pressure turbine section 3 and the intermediate pressure turbine section 4, and some of high-pressure steam from the high pressure turbine section 3 passes through the seal portion of the dummy ring 10, causing a leak to the side of the intermediate pressure turbine section 4. Therefore, if the leak amount is large, the performance is affected adversely, so that there is a fear of decreasing the performance of the high pressure turbine section 3.

OBJECT AND SUMMARY OF THE INVENTION

Accordingly, an object of the present invention is to provide a leak reducing structure in a steam turbine in which measures are taken to prevent a leak of high-pressure steam from a dummy ring for providing a seal between a high pressure turbine section and an intermediate pressure turbine section of the steam turbine to the intermediate pressure side, and the leaking steam is recovered to do work on the upstream side, by which the decrease in performance of the steam turbine can be prevented.

To solve the problem with the above-described prior art, the present invention provides the following means.

In a leak reducing structure in a steam turbine, in which high pressure, intermediate pressure, and low pressure turbine sections are arranged in the axial direction of a rotor in a single casing, and a dummy ring is disposed around the rotor between the high pressure turbine section and the intermediate pressure turbine section to provide a seal, a seal portion between the dummy ring and the rotor surface is caused to communicate with an intermediate point of a steam passage of the high pressure turbine section by a pipe, and steam passing through the seal portion of the dummy ring from the high pressure turbine section and leaking to the side of the intermediate pressure turbine section is recovered to the side of the high pressure turbine section.

In the above-described leak reducing structure in a steam turbine, in the high pressure turbine section, high-pressure steam is introduced, passes through the steam passage, drives the rotor to do work, and flows out through a port on the exhaust side. Some of the high-pressure steam passes through a gap between the dummy ring on the rotor side and the seal portion and attempts to leak to the intermediate pressure turbine side. A pipe is connected to an intermediate portion of the seal portion of dummy seal, and the pipe is connected to a point at an intermediate portion of the steam passage of the high pressure turbine section, where the pressure is lower than that on the dummy ring side, so that the leaking steam is recovered to the steam passage of the high pressure turbine section. The recovered steam combines with the steam of the high pressure turbine section, does work, and then flows out through an exhaust port of the high pressure turbine section. Therefore, the decrease in performance of the high pressure turbine section can be prevented.

The leak reducing structure in a steam turbine in accordance with the present invention is configured such that in a leak reducing structure in a steam turbine, in which high pressure, intermediate pressure, and low pressure turbine sections are arranged in the axial direction of a rotor in a single casing, and a dummy ring is disposed around the rotor between the high pressure turbine section and the intermediate pressure turbine section to provide a seal, a seal portion between the dummy ring and the rotor surface is caused to communicate with an intermediate point of a steam passage of the high pressure turbine section by a pipe, and steam passing through the seal portion of the dummy ring from the high pressure turbine section and leaking to the side of the intermediate pressure turbine section is recovered to the side of the high pressure turbine section. By this configuration, most of the steam that passes through the seal portion of the dummy ring from the high pressure turbine section and attempts to leak to the intermediate pressure turbine section is recovered, and combines with the steam flowing into the high pressure turbine section side to do work on the high pressure turbine section side. Therefore, the decrease in performance of the high pressure turbine section can be prevented.

DETAILED DESCRIPTION OF PREFERRED EMBODIMENTS

Figure 1:
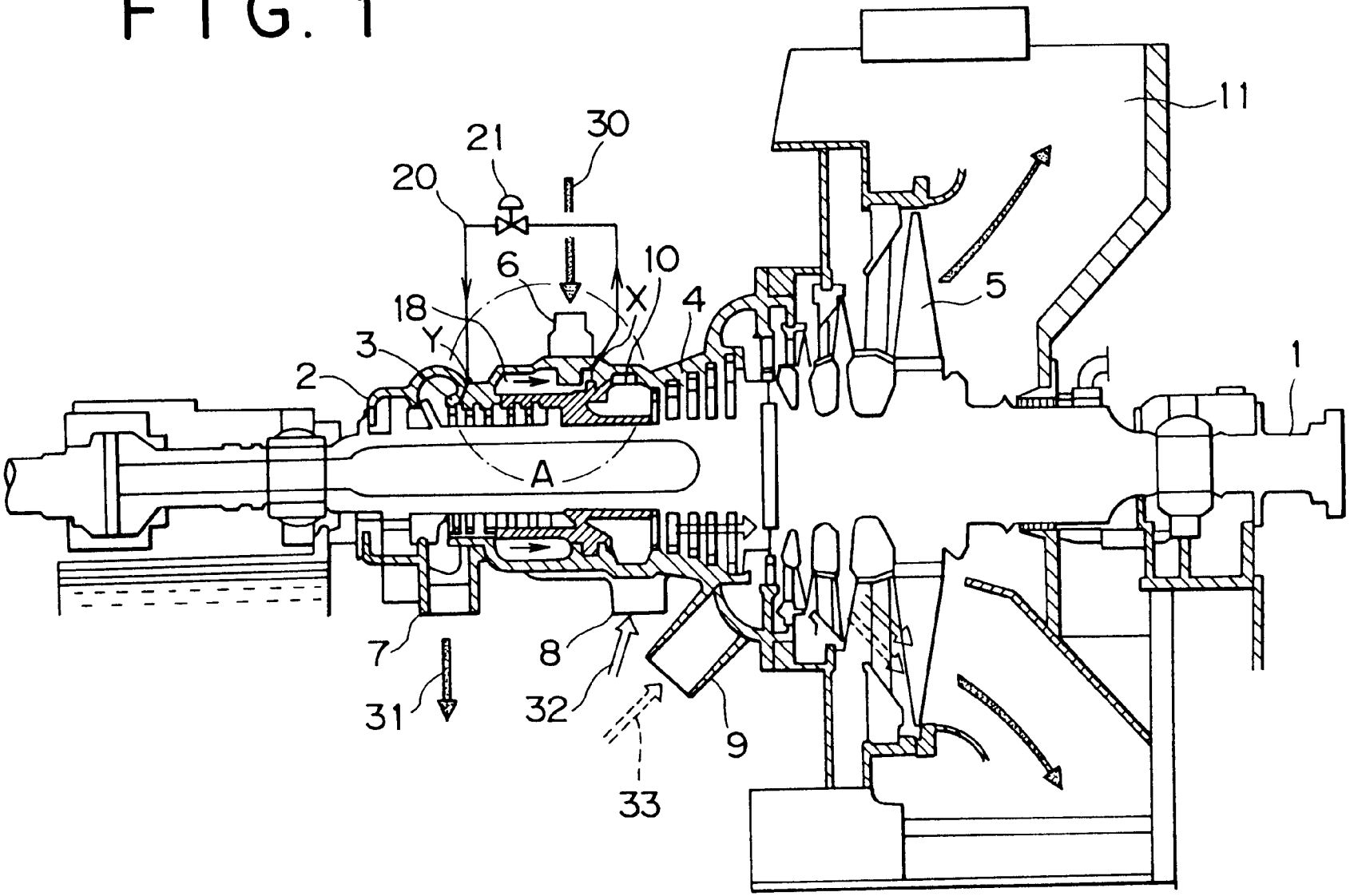
FIG. 1 is a sectional view showing a leak reducing structure in a steam turbine in accordance with one embodiment of the present invention.
Figure 2:
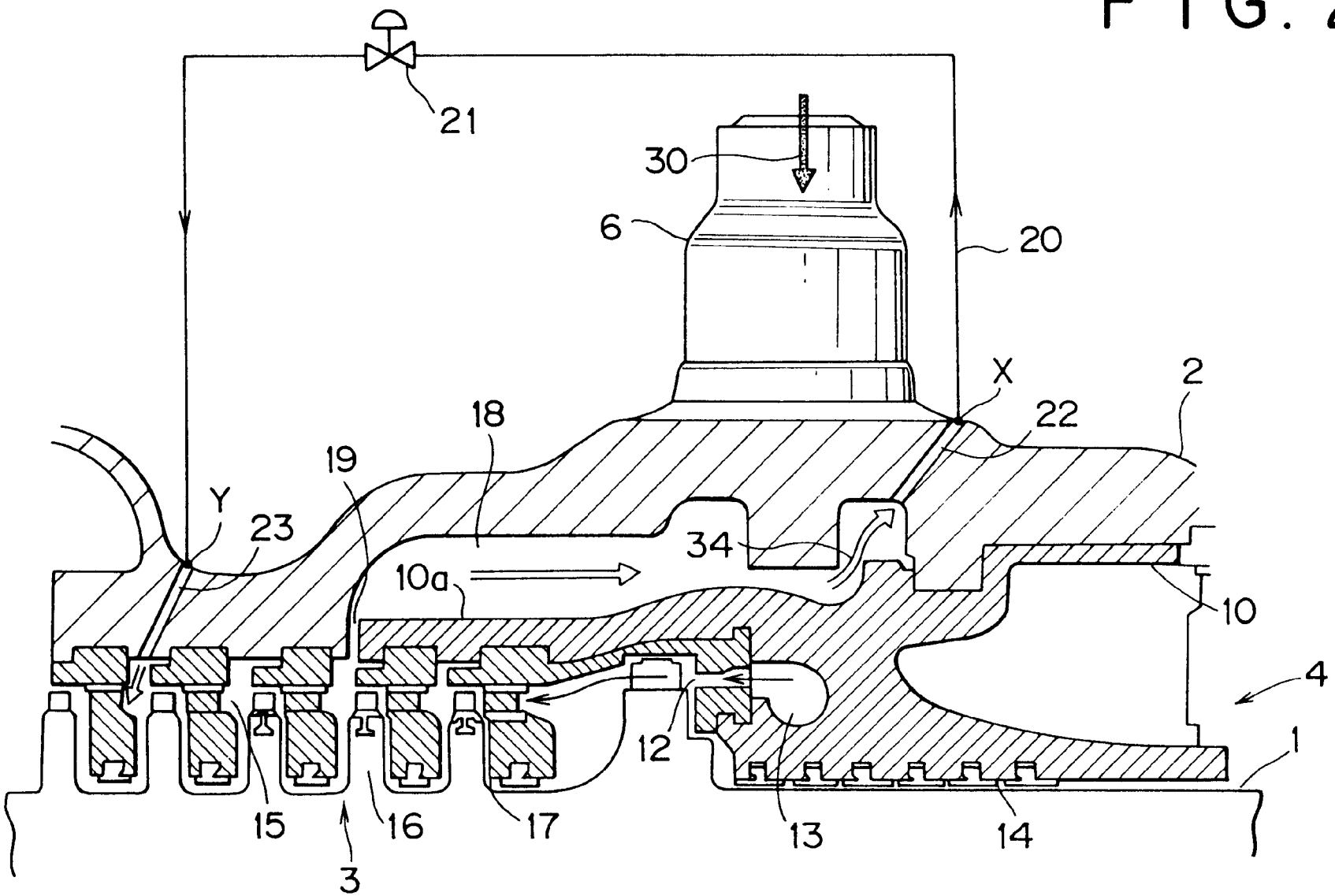
FIG. 2 is an enlarged detailed view of portion A in FIG. 1.
Figure 3:
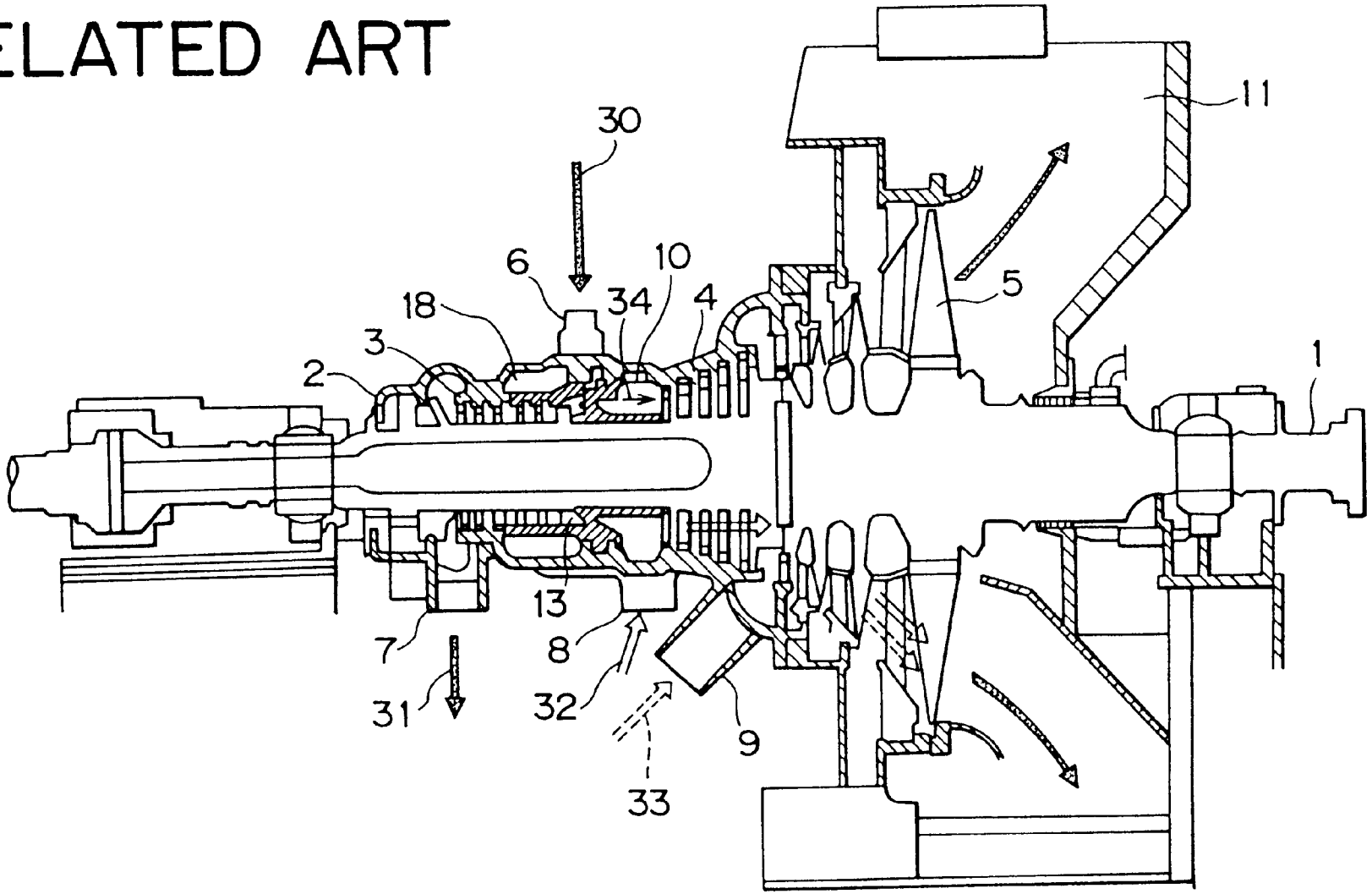
FIG. 3 RELATED ART
FIG. 3 is a sectional view of a conventional steam turbine of a single casing type.

An embodiment of the present invention will now be described with reference to the accompanying drawings. FIG. 1 is a sectional view showing a leak reducing structure in a steam turbine in accordance with one embodiment of the present invention, and FIG. 2 is an enlarged detailed view of portion A in FIG. 1. In FIG. 1, elements denoted by reference numerals 1 to 11, 13, and 30 to 33 are the same as those in the conventional example shown in FIG. 3, so that the detailed description thereof is omitted. The characteristic portion of the present invention is a portion denoted by reference numerals 20 and 21, so that this portion is described below in detail.

In FIG. 1, reference numeral 20 denotes an external pipe, and 21 denotes a pressure regulating valve provided at an intermediate position of the pipe 20. One end of the pipe 20 communicates with point X of the seal portion of the dummy ring 10, and the other end thereof communicates with point Y of a steam passage of the high pressure turbine section 3.

By providing the external pipe 20 described above, the steam that attempts to pass through the seal portion of the dummy ring 10 from the high pressure turbine section 3 and to leak to the side of the intermediate pressure turbine section 4 is caused to flow to an intermediate position of the steam passage of the high pressure turbine section 3 and is recovered to do work in the high pressure turbine section 3. Thereby, the leak amount is decreased, by which the decrease in performance of the high pressure turbine section 3 is prevented.

FIG. 2 is an enlarged detailed view of portion A in FIG. 1.

In this figure, the high pressure turbine section 3 is provided with a steam passage 15, and rotor blades 16 and stator blades 17 are arranged in a multi-stage form. The dummy ring 10 is provided with the nozzle chamber 13, which is provided integrally therewith, and nozzles 12. A seal portion 14 of the dummy ring 10 provides a seal between the high pressure turbine section 3 and the intermediate pressure turbine section 4.

The high-pressure steam 30 enters the external casing 2 through the high-pressure steam inlet port 6, flowing into the nozzle chamber 13 formed integrally with the dummy ring 10, and flows out to the steam passage 15 of the high pressure turbine section 3 through the nozzles 12. The high-pressure steam 30 passes between the stator blades 17 and the rotor blades 16 arranged in a multi-stage form to do work, and then flows out through the high-pressure steam outlet port 7 shown in FIG. 1.

Also, some of the high-pressure steam 30 flowing into the steam passage 15 passes through a gap 19 between the side of the rotor 1 and a side end portion 10*a* on the high pressure turbine section side of the dummy ring 10 and a space 18, and attempts to leak from the seal portion 14 to the side of the intermediate pressure turbine section 4 as the leak 34. However, most of the steam of the leak 34 flows into the external pipe 20 through point X of the seal portion 14, and flows to point Y of the steam passage 15 of the high pressure turbine section 3 via the pressure regulating valve 21 to be recovered. The recovered steam combines with the high-pressure steam 30, and does work in the high pressure turbine section 3.

For this purpose, the external casing 2 is formed with a hole 22 for providing communication between the space 18 and point X of the seal portion 14, and also formed with a hole 23 for providing communication between the steam passage 15 and point Y.

The above-described high-pressure steam 30 has a temperature of about 560° C. in the nozzle chamber 13, and about 500° C. in the vicinity of the first-stage rotor blade of the high pressure turbine section 3. The steam pressure is about 130 kg/cm$^2$ in the nozzle chamber 13, about 90 kg/cm$^2$ at the inlet portion of the steam passage 15 of the high pressure turbine section 3, and about 60 kg/cm$^2$ at point Y of the connecting portion of the external pipe 20.

On the other hand, the steam pressure at a portion from the space 18 of the dummy ring 10 to the vicinity of inlet portion of the seal portion 14 is about 90 kg/cm$^2$, and the steam pressure at the end portion of the seal portion 14 is about 30 kg/cm$^2$. The connecting point X at the seal portion 14 of the external pipe 20 is set at a position where the steam pressure is about 60 kg/cm$^2$ or somewhat higher.

The external pipe 20 is connected to point X at the above-described position and point Y of the steam passage 15 of the high pressure turbine section 3. For the pressures at point X and point Y, the pressure at point X is set so as to be slightly higher, and further the difference in pressure can be regulated by the pressure regulating valve 21. Therefore, the leak 34 entering the seal portion 14 of the dummy ring 10 flows from point X to point Y, so that most of the leak 34 does not flow to the side of the intermediate pressure turbine section 4, and is recovered to do work on the side of the high pressure turbine section 3. Therefore, the decrease in performance of the high pressure turbine section 3 can be prevented.

What is claimed is:

1. A steam turbine, comprising:

an outer casing;

a rotor passing axially through the casing;

a high-pressure turbine section disposed within the casing and supported on the rotor, the high-pressure turbine section defining a high-pressure steam passage having an upstream side and a downstream side;

an intermediate-pressure turbine section disposed within the casing and supported on the rotor axially adjacent to the upstream side of the high-pressure steam passage of the high-pressure turbine section;

a dummy ring mounted about the rotor and disposed between the high-pressure and intermediate-pressure turbine sections, the dummy ring having a seal portion operable to discourage high-pressure steam from flowing from the high-pressure turbine section into the intermediate-pressure turbine section; and a pipe having a first end fluidly coupled with the seal portion of the dummy ring and an opposite second end fluidly coupled with the high-pressure steam passage at an intermediate point between the upstream and downstream sides thereof, the pipe being arranged to recover steam leaking past the seal portion of the dummy ring toward the intermediate-pressure turbine section and to supply the recovered steam into the high-pressure turbine section for doing work therein.

2. The steam turbine of claim 1, wherein the casing and the seal portion of the dummy ring define a steam leakage pathway therebetween, and wherein the pipe is connected to the steam leakage pathway for recovering steam leaking therefrom.

3. The steam turbine of claim 2, wherein the pipe is connected to the steam leakage pathway at a first location thereof and is connected to the high-pressure steam passage at a second location thereof, and wherein the first and second locations are located such that a steam pressure existing at the first location is higher than a steam pressure existing at the second location.

4. The steam turbine of claim 1, further comprising a pressure regulating valve disposed at an intermediate position along the pipe for regulating flow of steam therethrough.

5. The steam turbine of claim 1, further comprising a low-pressure turbine section disposed in the casing and supported on the rotor.

6. A leak-reducing structure for a steam turbine of the type having at least a high-pressure turbine section and an intermediate-pressure turbine section axially adjacently supported on a rotor that passes axially through a casing surrounding the turbine sections, and wherein steam passages of the high-pressure and intermediate-pressure turbine sections are sealed from each other by a dummy ring that surrounds the rotor and is disposed between the turbine sections such that a potential steam leakage pathway from the high-pressure turbine section to the intermediate-pressure turbine section is defined between the casing and the dummy ring, the leak-reducing structure comprising:

a pipe providing a fluid coupling between the steam leakage pathway at the dummy ring and the steam passage of the high-pressure turbine section, the pipe being operable to recover steam from the steam leakage pathway and to supply the recovered steam into the steam passage of the high-pressure turbine section for doing work therein.

7. The leak-reducing structure of claim 6, wherein the pipe is connected to the steam leakage pathway at a first location thereof and is connected to the steam passage of the high-pressure turbine section at a second location thereof, and wherein the first and second locations are located such that a steam pressure existing at the first location is higher than a steam pressure existing at the second location.

8. The leak-reducing structure of claim 6, further comprising a pressure regulating valve disposed at an intermediate position along the pipe for regulating flow of steam therethrough.

* * * * *